US007658134B2

(12) United States Patent
Morgan

(10) Patent No.: US 7,658,134 B2
(45) Date of Patent: Feb. 9, 2010

(54) PUNCH WITH SELF-CONTAINED PUNCH RECESS ADJUSTMENT INDEXING

(75) Inventor: Christopher D. Morgan, Minneapolis, MN (US)

(73) Assignee: Mate Precision Tooling, Inc., Anoka, MN (US)

( * ) Notice: Subject to any disclaimer, the term of this patent is extended or adjusted under 35 U.S.C. 154(b) by 426 days.

(21) Appl. No.: 11/238,380

(22) Filed: Sep. 29, 2005

(65) Prior Publication Data

US 2007/0068352 A1 Mar. 29, 2007

(51) Int. Cl.
*B26D 7/26* (2006.01)
*B26F 1/14* (2006.01)

(52) U.S. Cl. ..... 83/530; 83/140; 83/686; 83/698.91

(58) Field of Classification Search ..... 83/137–143, 83/684–686, 698, 698.91, 530, 136, 651
See application file for complete search history.

(56) References Cited

U.S. PATENT DOCUMENTS

| | | | | |
|---|---|---|---|---|
| 4,375,774 A | | 3/1983 | Wilson et al. | |
| 5,020,407 A | * | 6/1991 | Brinlee | 83/530 |
| 5,054,347 A | * | 10/1991 | Johnson et al. | 83/140 |
| 5,131,303 A | | 7/1992 | Wilson et al. | |
| 5,301,580 A | | 4/1994 | Rosene et al. | |
| 5,329,835 A | | 7/1994 | Timp et al. | |
| 5,647,256 A | | 7/1997 | Schneider | |

(Continued)

FOREIGN PATENT DOCUMENTS

JP 2001-105053 * 4/2001

(Continued)

OTHER PUBLICATIONS

Mate Precision Tooling; Ultra Tooling, Ultra TecTooling, Fully Guided Tooling & Heavy-duty tooling, Date 2004 pp. 1-8 by Mate Precision Tooling Inc. Anoka MN, U.S.A.

*Primary Examiner*—Boyer D. Ashley
*Assistant Examiner*—Laura M. Lee
(74) *Attorney, Agent, or Firm*—James V. Harmon

(57) ABSTRACT

A punch canister includes a punch head with an axial shaft that has a screw thread which is adapted to be connected during use to the screw threads of a punch element that is slideably associated within a stripper bushing. A punch recess adjustment member is rotatably and slideably associated with the punch head. The adjustment member is adapted to the slideably but non-rotatably rotatably connected during operation to the punch element. A resilient retraction member, e.g., a spring, is located between the punch head and the adjustment member for biasing the adjustment member axially downward on the punch head. A manually releasable detent provided on the adjustment member is operatively associated with the punch head for retaining the adjustment member in any one of a plurality of selected circumferentially distributed angular positions on the punch head such that during operation disengagement of the detent allows the adjustment member and the punch element to be threaded axially on the punch head to control the distance that the punch element is recessed within the stripper bushing. In a preferred form, the detent is a lock that can be disengaged manually when the punch recess adjustment is to be made.

10 Claims, 5 Drawing Sheets

U.S. PATENT DOCUMENTS

| | | | | | |
|---|---|---|---|---|---|
| 5,662,016 | A | * | 9/1997 | Fujita | 83/137 |
| 5,752,424 | A | | 5/1998 | Rosene | |
| 5,832,798 | A | | 11/1998 | Schneider et al. | |
| 5,839,341 | A | * | 11/1998 | Johnson et al. | 83/530 |
| 5,884,546 | A | * | 3/1999 | Johnson | 83/530 |
| 6,082,516 | A | * | 7/2000 | Willer | 192/223.2 |
| 6,131,430 | A | | 10/2000 | Schneider et al. | |
| 6,276,247 | B1 | | 8/2001 | Helda | |
| 6,334,381 | B1 | | 1/2002 | Chatham | |
| 6,755,103 | B2 | | 6/2004 | Morehead | |
| 6,755,110 | B2 | | 6/2004 | Rosene et al. | |
| 6,782,787 | B2 | | 8/2004 | Morehead | |
| 6,895,797 | B2 | | 5/2005 | Lowry et al. | |
| 7,168,356 | B2 | * | 1/2007 | Rosene et al. | 83/686 |
| 7,168,364 | B2 | | 1/2007 | Schneider | |
| 2004/0206223 | A1 | | 10/2004 | Rosene et al. | |
| 2004/0255742 | A1 | | 12/2004 | Morehead | |

FOREIGN PATENT DOCUMENTS

| | | | |
|---|---|---|---|
| JP | 2002-205130 | * | 7/2002 |

* cited by examiner 24
26
punch head
36a
30
24a
Screw threads
28 Axial shaft
36
punch canister 10
38
resilient punch retraction member
40
44
46
77
40
spring retainer
66
76
32
42
punch recess adjustment member
52
detent
34
50
70
72
52b
80
82 locating pin holds member 52 non-rotatably to punch element 14
22a
14 punch insert or element
"stock" punch and stripper set 12
22 guide bushing of punch set
84 pin
punch tip 18
23
23
20 stripper opening

PUNCH WITH SELF-CONTAINED PUNCH RECESS ADJUSTMENT INDEXING

FIELD OF THE INVENTION

This invention relates to the punch and die art and especially to improved punch recess adjustment.

BACKGROUND OF THE INVENTION

In the punch and die art and particularly in the field of high-speed automated forming and punching equipment for punching and forming sheet material, e.g., sheet metal and especially in the case of automated turret punch presses, the punch presses are operated by computer to perform a series of punching or forming operations sequentially. These punch presses which by themselves form no part of the present invention are typically provided with an upper turret and a lower turret that rotate and are indexed intermittently between punching operations. The turrets may, for example, hold as many as a dozen or more separate punches that are used in sequence for performing given operations. When a punch is struck from above by the ram of the punch press, the punch element or punch insert is driven downwardly through the workpiece to perform the punching operation. When released, the punch insert is retracted by a spring provided in the punch assembly. In order to assure a clean separation between the workpiece and the punch insert, a stripper having an opening shaped to conform to the tip of the punch is used to strip the workpiece from the punch tip. The stripper can either be a separate piece or it can be built into the punch guide bushing. When the punch assembly is placed in the punch press, it is important to assure that the tip of the punch is recessed the correct distance within the stripper. In many punching operations it is common for the operator to recess the punch about 0.032 inches within the stripper, i.e., providing a lead of about 0.032 inches.

The present invention described below and shown in the Figures can be applied to a variety of different kinds of punch set types including relatively large diameter punch sets in which the stripper comprises a flat removable circular stripper plate as well as those of a smaller size in which the stripper comprises the lower end of bushing that encloses the punch insert. Although the invention can be applied to punch sets in which stripper and bushing as well as the punch insert are custom made by the manufacturer, it is particularly applicable to stock punch and stripper sets of a relatively small size that are supplied by numerous manufacturers and are available commercially in many standard sizes and configurations. These "stock" or standard size punch sets are usually kept in stock by the end user. To make a complete punch mechanism using a stock punch insert and stripper set, the manufacturer provides the punch head and spring assembly to which the user attaches his punch insert and stripper bushing. The punch assembly provided by the manufacturer is commonly referred to as a punch canister and consists of a punch head which has threads for engaging the threads of the punch insert, a retraction spring, and includes a provision for holding the spring in place. Since the punch insert and stripper set has nothing for adjusting the punch recess, the entire mechanism for controlling the punch lead or recess must be contained in the punch canister assembly. While the invention is particularly well adapted for use in a canister punch assembly of the kind described, it can be practiced in a variety of punch sets of different types. A preferred embodiment that is described and shown in the Figures illustrates but one of the various ways that the invention can be practiced within the scope of the appended claims.

Various punch assembly adjustment devices previously proposed are described in U.S. Pat. Nos. 6,895,797; 5,647,256; 5,329,835; and 4,375,774. In some cases the recess adjustment of the punch is contained on or within the punch insert or is a part of the bushing which surrounds it. This, of course, is unacceptable for a canister style punch assembly since the "stock," i.e., commercially available, punch insert and stripper bushing sets contain no recess adjustment feature. In other cases, changes in the recess or lead of the punch insert can only be made by partially or completely disassembling the punch set or by using tools to make changes in the punch lead. In the case of U.S. Pat. Nos. 5,647,256 and 6,895,797, the punch assemblies are not suited for use with a stock punch set provided by the end user but must include the punch and/or stripper supplied by the manufacturer as a part of the complete assembly. In addition, recess adjustments cannot be made with the punch insert in situ.

In view of these and other deficiencies of the prior art, it is one object of the present invention to provide a punch assembly with a self-contained device in which changes in the distance the punch is recessed within the stripper can be made manually without the use of tools.

Another object of the invention is the provision of an improved punch assembly having a recess adjustment in which the entire recess adjustment mechanism is contained within a canister style punch set can be used in conjunction with a any of a variety of standard size, i.e., "stock," punch insert and stripper bushing sets that are kept in stock by the end user and are attached or replaced on the canister assembly as needed and including a feature for enabling the recess adjustment of the punch to be made with the punch in situ whereby the recess adjustment can be observed by the operator while being made.

Another more specific object of the invention is the provision of an improved punch assembly in which precise recess adjustments can be easily made without tools and in which the punching operation is performed by a punch insert and stripper guide bushing set that together have no adjustment feature and which can be removed together and replaced by hand without the use of tools whenever required.

These and other more detailed and specific objects of the present invention will be better understood by reference to the following figures and detailed description which illustrate by way of example but a few of the various forms of the invention within the scope of the appended claims.

BRIEF SUMMARY OF THE INVENTION

The invention relates to a punch assembly, typically a punch canister which includes a punch head having an axial shaft with a screw thread that is adapted to be connected during use to a punch element which has cooperating threads and is slideably associated with a guide bushing and stripper. A punch recess adjustment member is rotatably and slideably associated with the punch head. The adjustment member is adapted to the slideably but non-rotatably connected during operation to the punch element. A resilient retraction member, e.g., a spring, is positioned between the punch head and the adjustment member for yieldably biasing the adjustment member axially downward on the punch head. A detent is provided on the adjustment member and is operatively associated with the punch head for retaining the adjustment member in any of several selected circumferentially distributed angular positions on the punch head such that, during operation, disengagement of the retainer detent allows the adjustment member and the punch element to be rotated on the punch head such that the punch element is threaded axially on the punch head to control the distance that the punch element is recessed within the stripper. In a preferred form, the detent is a lock that can be disengaged manually but when engaged will hold the adjustment member in one of several indexing positions.

DETAILED DESCRIPTION OF THE INVENTION

Figure 1:
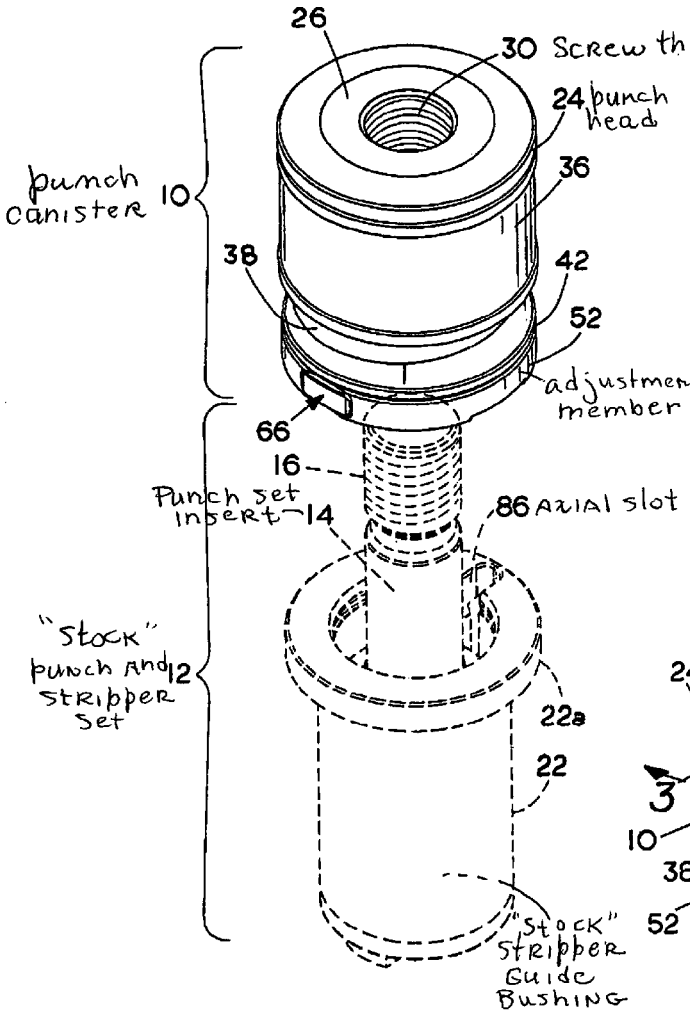
FIG. 1 is a perspective view of one form of punch assembly embodying the invention as seen from above including a standard punch insert and stripper bushing set in position for attachment.
Figure 1A:
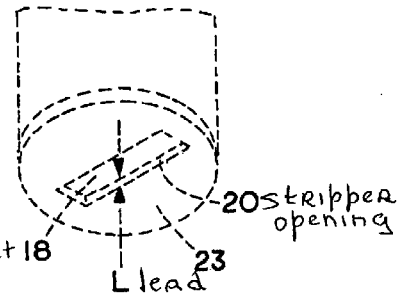
FIG. 1A is a partial perspective view of the lower end of the punch set as seen from below.
Figure 2:
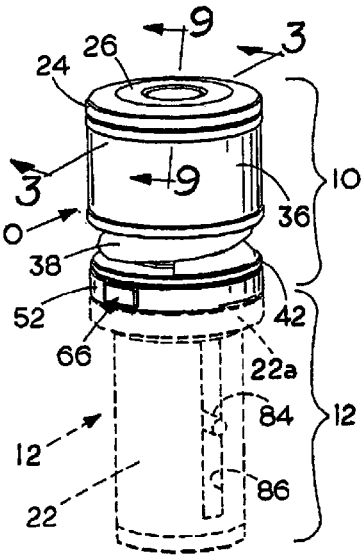
FIG. 2 is a perspective view similar to FIG. 1 on a reduced scale showing a standard punch insert and stripper set in the installed position ready for operation.
Figure 3:
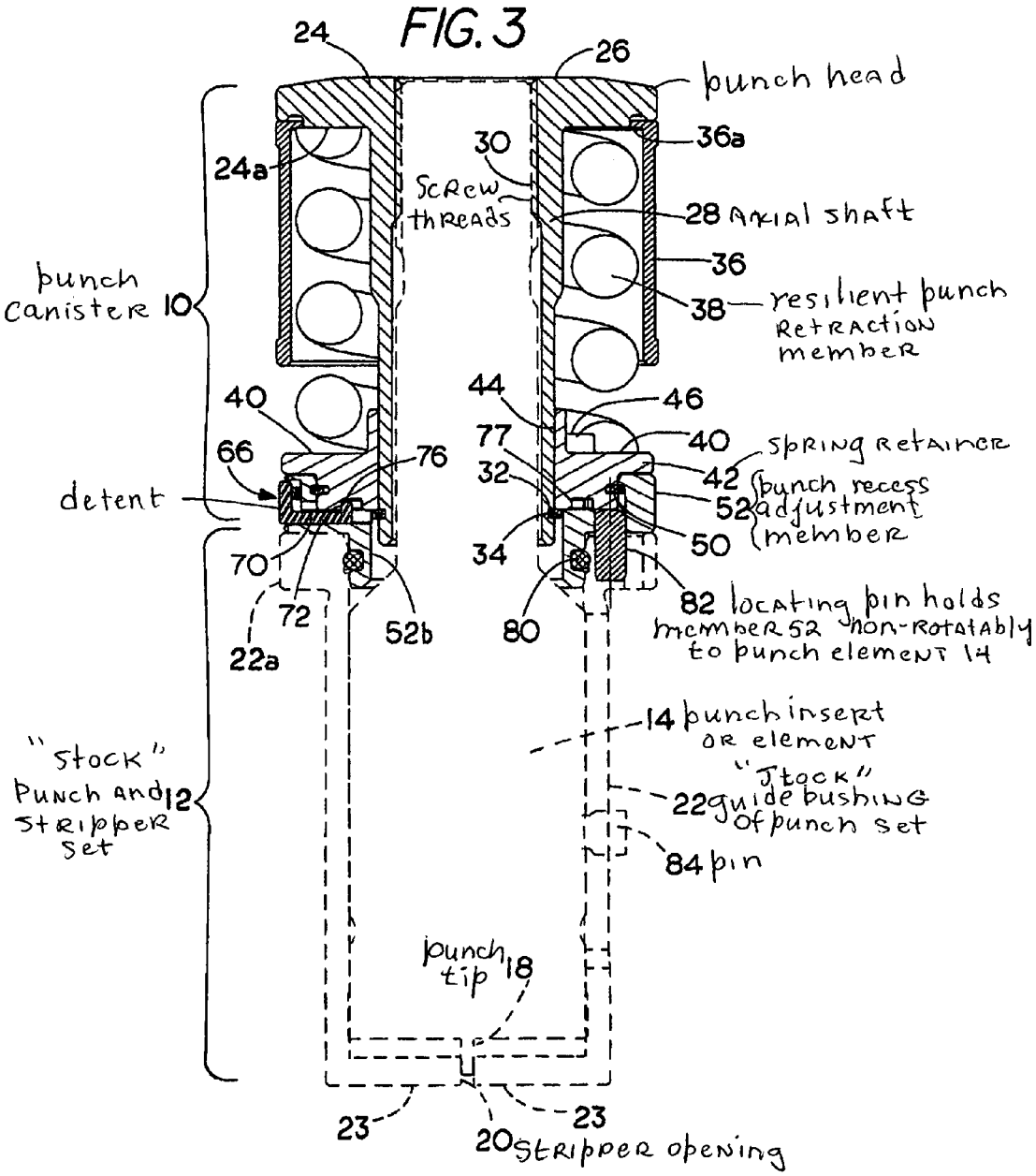
FIG. 3 is a vertical sectional view taken on line 3-3 of FIG. 2.

Shown in FIGS. 1, 2, and 3 is a canister 10 in accordance with the invention and a standard or "stock" punch and stripper set 12 that is available commercially from any of a number suppliers and is ordinarily provided by the end user in various standard sizes. The punch and stripper set 12 includes a punch insert 14 having a threaded upper end 16 and a punch tip 18 (FIGS. 1A and 3) that extends through a stripper opening 20 in a standard stripper guide bushing 22. At its upper end, the stripper guide bushing 22 is provided with a flange 22*a* that extends outwardly therefrom for supporting the punch canister 10 and punch set 12 on a punch press (not shown) during operation. The purpose of the invention is to provide, as shown in FIG. 1A, an adjustment in the recess of the tip 18 of the punch insert 14 above the lower surface 23 of the stripper bushing assembly 22. This recess distance is commonly referred to as the lead and is designated L in FIG. 1A. In many applications L is set at about 0.032 inches. It can be seen that the standard punch insert and stripper set 12 has no provision for adjusting the lead L. Accordingly, the entire adjustment mechanism in accordance with the invention is self-contained within the punch canister 10.

Figure 4:
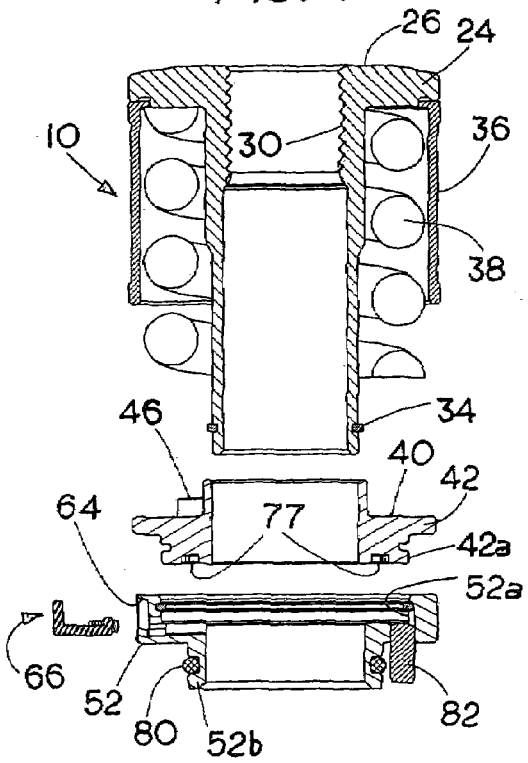
FIG. 4 is a vertical exposed cross-sectional view similar to FIG. 3 on a reduced scale.
Figure 5:
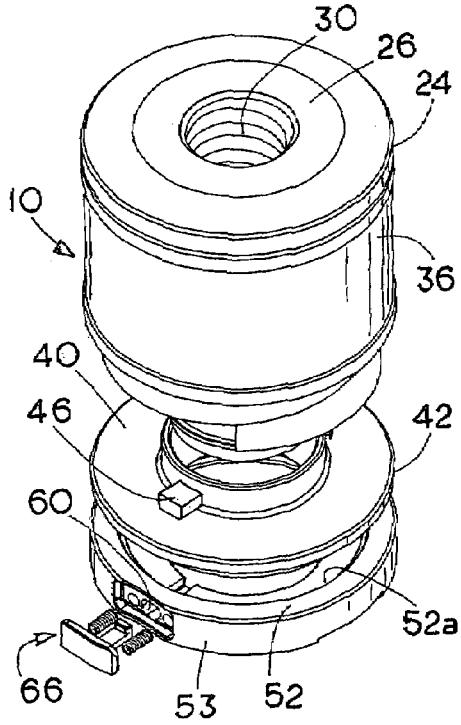
FIG. 5 is an exploded perspective view of the invention as seen from above.
Figure 6:
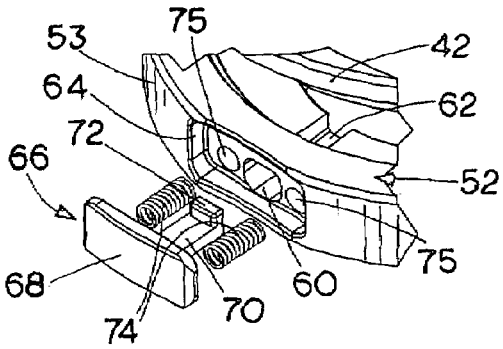
FIG. 6 is a partial enlarged perspective view of the detent assembly.
Figure 7:
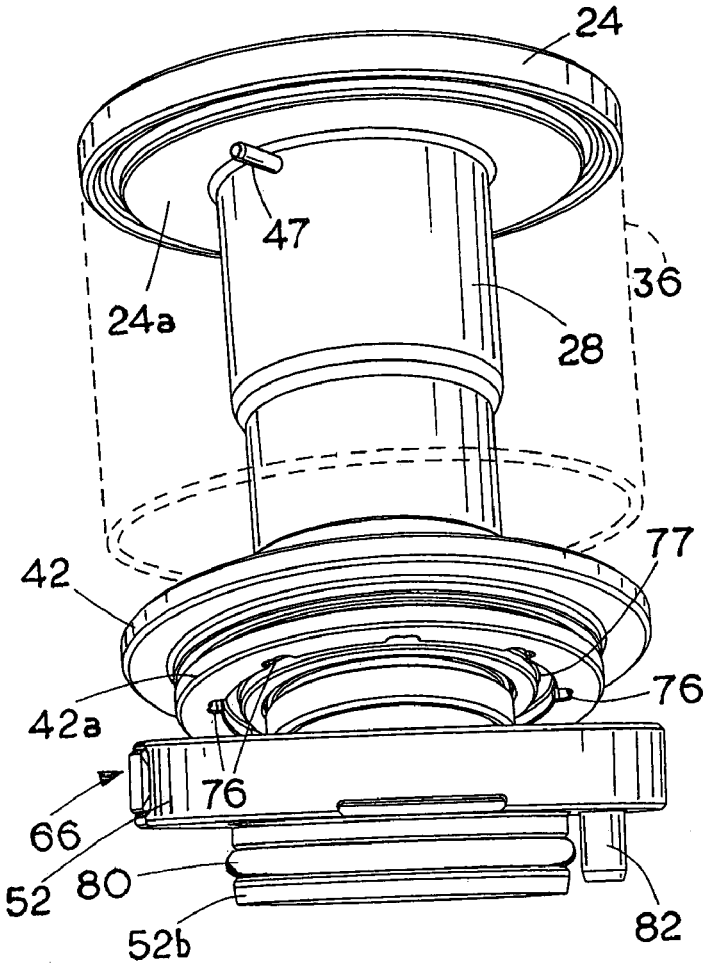
FIG. 7 is a perspective view of the invention with the spring removed in which the recess adjustment member is shown as it appears just before being attached to the spring retainer.
Figure 8:
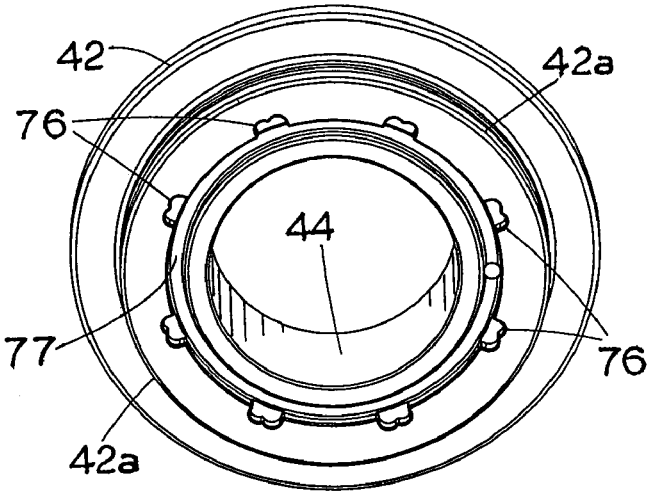
FIG. 8 is a bottom perspective view of the spring retainer.
Figure 9:
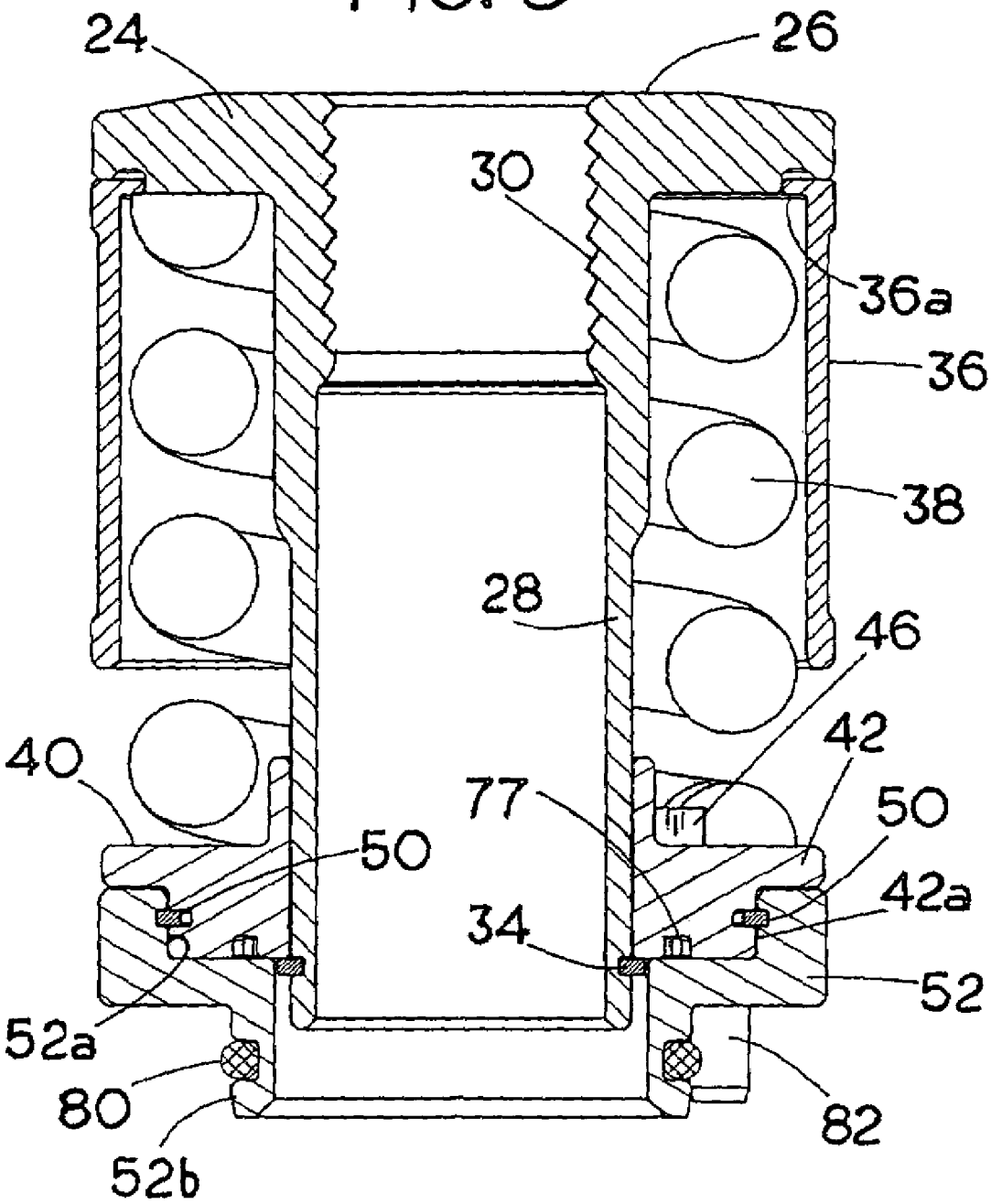
FIG. 9 is a vertical section view of the canister assembly taken on line 9-9 of FIG. 2.

The punch canister 10 will be described in more detail in connection with FIGS. 3-9. Referring especially to FIGS. 3 and 4, it will be seen that the punch canister 10 includes a punch head 24 with an upwardly exposed ram contact surface 26 which is struck by the ram of the punch press (not shown) during operation. The punch head 24 also includes a centrally located tubular downward extension 28, with axial threads 30 to which the threads 16 of the punch insert 14 is secure during operation. At its lower end is a circumferentially extending outwardly facing recess 32 for a stop or holder, e.g., a snap ring 34 made of spring steel. Secured to the outer side of the punch head 24 and extending downwardly therefrom is a tubular spring cover 36 on which can be printed manufacturers information, product designation, and directions for use, etc., if desired. In a preferred form, a circular spring retainer 42 is provided in contact with the lower end of spring 38 and adjacent an adjustment member 52 located below it. The spring cover has a centrally extending upper circular flange 36*a* which is pressed against a lower surface 24*a* of the punch head 24 by a helical compression spring 38, the upper end of which, as shown in FIG. 3, also engages the lower surface 24*a* of the punch head 24 and the lower end of which contacts the upper surface 40 of the spring retainer 42 which has a central bore 44 that is slideably mounted on a punch head extension 28 just above the snap ring 34 which supports retainer 42. On the upper surface of the retainer 42 is an upwardly extending lug 46 for keying, i.e., preventing rotation between the spring 38 and the retainer 42 and the top of the spring 38 is keyed to the punch head by pin 47 (FIG. 7). Spring 38 engages and retains the spring cover 36 in place as shown in FIG. 3. Thus, when assembled, the spring 38 is held under compression by the snap ring 34 between the lower surface 24*a* of punch head 24 and the retaining ring 42.

Secured to the retainer 42 by means of a connector, e.g. a circular snap ring 50 (FIG. 9) is a punch recess adjustment member 52. As shown in FIGS. 3, 4, 5, and 6, the adjustment member 52 is provided with an axial bore 52*a* to receive a cylindrical downwardly projecting boss 42*a* of the spring retainer 42. As shown in FIGS. 5 & 6, the outer wall 53 of the adjustment member 52 is provided with a radial opening 60 that communicates interiorly with a channel 62 and with an outer pocket 64 to receive a detent, in this case a locking detent button 66 having a manually engagable exposed outer contact surface 68, a radially extending shaft 70 that is provided at its inner end with an upwardly extending tab 72. On either side of the contact surface 68 are compression springs 74 which fit into sockets 75 to yieldably bias the detent 66 outwardly.

Centered on the lower surface of the retainer 42 is a downwardly opening circular groove 77 that is aligned with tab 72 when the detent 66 is pressed centrally against compression spring 74 so as to disengage the locking detent 66 and enable the entire upper portion of the canister including the retaining ring 42 to be rotated manually relative to the adjustment member 52 and punch set 12 including the punch insert 14. However, when manual pressure on the face 68 of the detent 66 is released, the tab 72 can enter one of the sockets 76 thereby preventing further rotation so as to securely lock the punch 14 including the tip 18 and thereby provide the lead L that has been selected by turning the canister 10 with the detent 66 pressed in, i.e., disengaged.

The detent 66 may have various forms. For example, if desired the detent 66 could be a ball detent of the type in which the ball is forced into any of the sockets 76 by a spring that will permit an adjustment to be made by rotating related parts to thereby repeatedly force the ball out of each successive socket 76 as the parts rotate relative to one another. However, the locking detent shown is highly preferred since there will then be no opportunity for the parts to rotate relative to one another until the outer manually engagable button surface 68 of the detent 66 is pressed inwardly against the compression of the springs 74 to thereby slide the tab 72 out of the socket 76 in which it is engaged. This provides a more positive action to assure that no slippage can occur during use.

The adjustment member 52 has downwardly extending retaining sleeve 52*b* with an outwardly facing recess for receiving an O ring 80 which serves to hold the punch stripper bushing 22 in place frictionally during use. The stripper bushing 22 is keyed to the adjustment member 52 by means of an axially extending locating pin 82 (FIGS. 3 and 4). The punch element 14 is in turn keyed to the stripper guide bushing 22 by means of a radially extending pin 84 that extends through an axial slot 86 in the wall of the stripper guide bushing 22. From the description given it will be seen that pressure provided by the spring 38 will press the spring retainer 42 against the snap ring 34 and the lug 46 will key the retaining ring 42 to the spring 38 and the punch head 24 while the snap ring 50 allows the recess adjustment member 52 to rotate freely relative to the retaining ring 42 as long as the detent 66 is disengaged.

To assemble the canister 10, the spring cover 36 and spring 38 are mounted on the punch head 24 followed by the retaining ring 42 which is held in place by the snap ring 34. The adjustment member 52 is then secured to the retaining ring 42 by snap ring 50. During operation, the lug 46 keys the retaining ring 42 to the punch head 24. The adjustment member 52 is however free to rotate relative to the retaining ring 42 as long as the detent 66 is disengaged from one of the sockets by pressing on the exposed contact surface 66. When this is done, the punch head 24, spring 38, and retainer42 can be rotated about a central vertical axis without moving the adjustment member 52 which as described is keyed by pin 82 to the stripper guide bushing 22 which in turn is keyed to the punch insert 14 by means of the pin 84. In this way, the recess or lead L of the punch head 18 above the lower surface 23 of the stripper bushing 22 can be precisely set as required by the punch press operator with the punch insert in situ within the stripper 22 thereby allowing the lead L to be observed while being adjusted.

It can thus be seen that the recess adjustment is accomplished entirely within the canister 10 and can be performed without the use of tools of any kind. It is also possible to easily make the adjustment while observing changes in the lead L (FIG. 1A) thereby allowing changes to be more quickly and efficiently accomplished. In a typical embodiment, by moving from one socket 76 to the next, an operator can effect a change in lead L of say 0.002 inches so that one complete turn equals 0.016 inches. The invention also makes it possible for the user's stock punch and stripper set to be securely and reliably held on the canister 10 by means of the rubber O ring 80 and pin 82. After a period of use, the punch set 12 can be removed manually simply by pulling downwardly on the stripper bushing 22. Moreover, no spring is needed between components 10 and 12 which if present would tend to force them apart. Adjustments can be made without separating the canister 10 from the stripper guide 22 so that they can be seen while being made or even made on the press if desired. Since the adjustment is made entirely within the canister 10, the invention can be used with any standard, i.e., "stock," stripper and guide set provided by an end user or any commercial brand of stripper guide and punch insert set. While the invention has been shown, by way of example, for use in connection with smaller size punch and die sets that consist of stock punch and stripper bushings supplied by the user, the invention is applicable to many types and sizes of punch and die assemblies.

Many variations of the present invention within the scope of the appended claims will be apparent to those skilled in the art once the principles described herein are understood.

What is claimed is:

1. A punch canister with a self-contained punch recess adjustment for use with an attachable punch set that includes a guide bushing having a stripper and a punch element, said canister comprising, a canister body having a top end, a bottom end and a central axis extending therebetween, a punch head at the top end of the canister body including an axial shaft with an axial screw thread located for engagement with a punch set, an annular punch recess adjustment member as a part of the canister body at the bottom end thereof that is constructed and arranged for removable attachment to the punch set, the adjustment member being rotatable and slidable on said axis relative to the punch head, a resilient punch retraction member positioned between the punch head and the adjustment member for biasing the adjustment member axially downward on the punch head, a locating element positioned on said adjustment member that is operatively related to the guide bushing of the punch set to prevent rotation between the punch set and the adjustment member when attached thereto, a plurality of circumferentially distributed sockets that are non-rotatably associated with the punch head, a detent on the adjustment member which is operatively associated with the punch head for retaining the adjustment member in a selected one of a plurality of circumferentially distributed angular positions on the punch head by engagement with said plurality of sockets, the detent being disengageable from said plurality of sockets for enabling an operator to rotate the adjustment member relative to the punch head, such that rotation of the adjustment member relative to the punch head rotates the bushing of the punch set relative to the punch head for adjusting the punch set.

2. The punch canister of claim 1 including a spring retainer positioned between the resilient member and the punch recess adjustment member and the spring retainer is slideably mounted on the punch canister but non-rotatably associated with the punch head, the spring retainer having said plurality of sockets therein.

3. The punch canister of claim 2 wherein the detent is operatively associated between the adjustment member and the spring retainer.

4. The punch canister of claim 1 wherein the detent is releasably held in locked relationship with the punch element to prevent rotation of the adjustment member when the punch element is in a selected position.

5. The punch canister of claim 1 wherein the detent has a manually engageable contact surface for releasing the detent from a locked relationship with the canister body that prevents rotation of the adjustment member thereon.

6. The punch canister of claim 1 wherein the adjustment member includes an axial sleeve for frictionally retaining the punch set thereon following attachment of the canister to the punch set.

7. The punch canister of claim 6 wherein a resilient ring member surrounds the sleeve to provide frictional support for the punch set upon a lower end of the adjustment member.

8. The punch canister of claim 1 wherein the punch head includes a downwardly extending tubular spring cover extending therefrom to at least partially enclose the resilient punch retraction member.

9. The punch canister of claim 1 wherein the detent has an exposed contact surface that can be pressed manually by an operator to thereby unlock the adjustment member from the punch head.

10. The punch canister of claim 1 wherein the locating element projects downwardly from the adjustment member.

* * * * *